United States Patent [19]

Bialkowski et al.

[11] Patent Number: 5,064,976

[45] Date of Patent: Nov. 12, 1991

[54] CONTACT CONFIGURATION FOR A VACUUM INTERRUPTER

[75] Inventors: Guenter Bialkowski; Dieter Gerlach; Roman Renz, all of Berlin, Fed. Rep. of Germany

[73] Assignee: Siemens Aktiengesellschaft, Berlin and Munich, Fed. Rep. of Germany

[21] Appl. No.: 556,012

[22] Filed: Jul. 20, 1990

[30] Foreign Application Priority Data

Jul. 28, 1989 [EP] European Pat. Off. ..... 89250009

[51] Int. Cl.[5] ..... H01H 33/66

[52] U.S. Cl. ..... 200/144 B

[58] Field of Search ..... 200/144 B

[56] References Cited

FOREIGN PATENT DOCUMENTS 0119563 9/1984 European Pat. Off. .
0163593 12/1985 European Pat. Off. .
0155376 6/1987 European Pat. Off. .
3227482 2/1983 Fed. Rep. of Germany .
3231593 3/1984 Fed. Rep. of Germany .
3334493 4/1985 Fed. Rep. of Germany .
3407088 8/1985 Fed. Rep. of Germany ... 200/144 B

*Primary Examiner*—Harold Broome
*Attorney, Agent, or Firm*—Kenyon & Kenyon

[57] ABSTRACT

A contact configuration, whose axially opposed contacts have a current-supplying stud, a cup-shaped contact carrier and a contact plate set up on the rim of the contact carrier, a support consisting of material with poor electrical conductivity being provided to mechanically stabilize the contact plate. The support forms a tubular supporting region and is located on a graduated circle whose diameter is at most equal to the diameter of the current-supplying stud. The diameter of the current-supplying stud thereby equals at least 50% of the external diameter of the contact carrier. The length of the support has a considerably smaller cross section in its middle than in its base and top region so that the ohmic resistance of the support is at least approximately one magnitude greater than the ohmic resistance of the contact carrier and contact plate.

9 Claims, 3 Drawing Sheets

CONTACT CONFIGURATION FOR A VACUUM INTERRUPTER

BACKGROUND OF THE INVENTION

The present invention relates to the field of vacuum interrupters and is to be applied in the structural design of a contact configuration which comprises two axially opposed contacts, whereby each contact has a cup-shaped design and is provided with a support structure for the contact plate.

A known contact configuration for a vacuum interrupter consists of two contacts which are arranged equiaxially and are able to move relative to each other in their axial direction, and having contact carriers which are provided with a current-supplying stud have a cup-shaped design and provided with tilted slots to generate an axial magnetic field (axial field contacts). On the rim of each contact carrier wall, a contact plate consisting of a contact material is soldered onto a chromium-copper base. In order to mechanically stabilize the contact, a basically columnar support which consists of material with poor electrical conductivity, e.g., of a nonmagnetic material such as chromium nickel steel, is provided between the slotted contact carrier and the equally slotted contact plate. This support is centrally mounted and in cross section approximately has the shape of an H-armature carrier (DE-A-32 31 593). In the case of other known contact configurations, the support, which is also basically columnar, is widened in an umbrellalike manner only at the end which is turned towards the contact plate (DE-A-33 34 493), or it has a relatively narrow supporting core and is provided at the ends of this supporting core with plate-like supporting parts (EP-A-0 155 376). In these types of contact configurations, there is a concentration of current in the region of the supports when the contact is closed that can cause the contacts to fuse together when rated short-time withstand currents occur which are greater than 50 kA. This type of fusing can also occur when the support is designed as a hollow cylinder which is mounted on a graduated circle corresponding to the average wall diameter of the hollow cylinder within the cross-sectional area of the current-supplying stud while leaving free a central cross-sectional region (DE-OS 32 27 482). In this connection, the disadvantage of having a relatively large shunt across the support continues to exist, whereby the formation of an effective axial magnetic field is obstructed.

SUMMARY OF THE INVENTION

It is an object of the present invention to provide a contact configuration such that with a small shunt across the support, the fusing of the contact plates is reliably excluded.

The above and other objects of the invention are achieved by a contact configuration for a vacuum interrupter, comprising two axially opposed axial field contacts which are able to move relative to each other in an axial direction, each axial field contact comprising a cup-shaped contact carrier and a contact plate which is set up on the rim of the contact carrier wall, each contact carrier being provided with a cylindrical current-supplying stud, the wall of each contact carrier being provided with slots which form windings that are tilted towards the contact axis, a support comprising a material which has poor electrical conductivity being mounted between the contact carrier and contact plate of each axial field contact, the support being located on a graduated circle within the cross-sectional area of the current-supplying stud while leaving free a central cross-sectional region, the diameter of the current-supplying stud equalling at least 50% of the external diameter of the contact carrier, the diameter of the graduated circle for the support also equalling at least 50% of the external diameter of the contact carrier and being at most equal to the external diameter of the current-supplying stud, and the length of the support having a considerably smaller cross section in the middle than in the base and top region, so that the ohmic resistance of the support is at least approximately one magnitude greater than the ohmic resistance of the contact carrier and the contact plate.

In the case of such an amendment of the contacts, the adhesion which is caused by the support is distributed to such a great surface area of the contact plates that, on the one hand, the thus resulting contact surface is reliably greater than that critical contact surface whereby a using- of both contact surfaces is to be expected; and that, on the other hand, the shunt across the support is sufficiently small. With that, the enlarged cross section in the base and top region of the support ensures that the support, which has the least possible wall thickness while allowing for the requisite ohmic resistance, does not press into the base of the contact carrier nor into the contact plate under the influence of the axial mechanical forces.

For example, the support can consist of a thin-walled tube which is provided with tubular supporting surfaces at both ends. These supporting surfaces can also comprise flange-type mounts. The corresponding graduated circle, upon which this tube is to be mounted, then corresponds with regard to its diameter to the average wall diameter of the tube.

In order to guarantee a greatest possible electrical resistance of the support, it is advantageous when the support comprising several supporting elements which form parallel electric current paths mounted on a graduated circle. This formation of parallel current paths can take place in that tubular or post-like supporting elements which are mounted on the graduated circle in a uniform distribution in a quantity of at least three pieces are used as a support. While keeping in mind that the contact plate of the respective individual contacts is usually slotted, it is prudent, however, to allot one supporting element to one sectioned segment of the contact plate, respectively. The electrical resistance of the supporting elements can be adjusted to the requisite value by appropriately designing the cross section.

However, one can also provide a support in the form of a tubular support structure whose wall is provided with several, preferably at least ten, at most approximately twenty, radial perforations. The wall regions between the perforations then form the individual current paths. The diameter of the preferably round perforations is effectively approximately 50% of the length of the tubular support structure. By this means, a sufficient mechanical stability of the support is guaranteed at a sufficiently greater ohmic resistance. The present support is practically designed so that it has a resistance of at least approximately 40 to 50 uohm, preferably of approximately 100 uohm.

In order to offset the electrodynamic axial forces which are generated in the contacts during high flows of current, it is further recommended that the supporting elements be fixed into place at both ends. This practically takes place by means of hard-soldering, indeed by joining the supporting elements on the front side to the contact plate, and by joining the supporting elements on the front or housing side to the contact carrier. The housing sided connection thereby makes the desired tolerance adjustment possible within a suitable fitting range. When using post-like supporting elements, the housing sided connection can take place in the region of a spigot which engages with a bore hole of the contact carrier.

The development of the support provided according to the invention is especially to be considered for those axial field contacts in which the external diameter of the contact carrier equals 60 to 150 mm and in which the contact plate consists of a contact material on a chromium-copper base.

BRIEF DESCRIPTION OF THE DRAWINGS

The invention will be described in greater detail in the following detailed description with reference to the drawings, in which.

DETAILED DESCRIPTION

Figure 1:
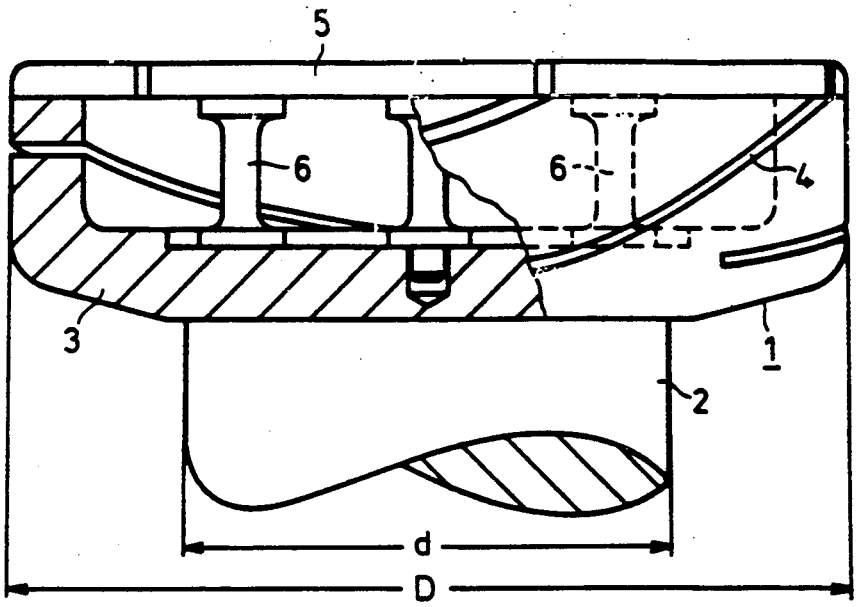
FIG. 1 shows an axial field contact with post-like supporting elements in cross section.
Figure 2:
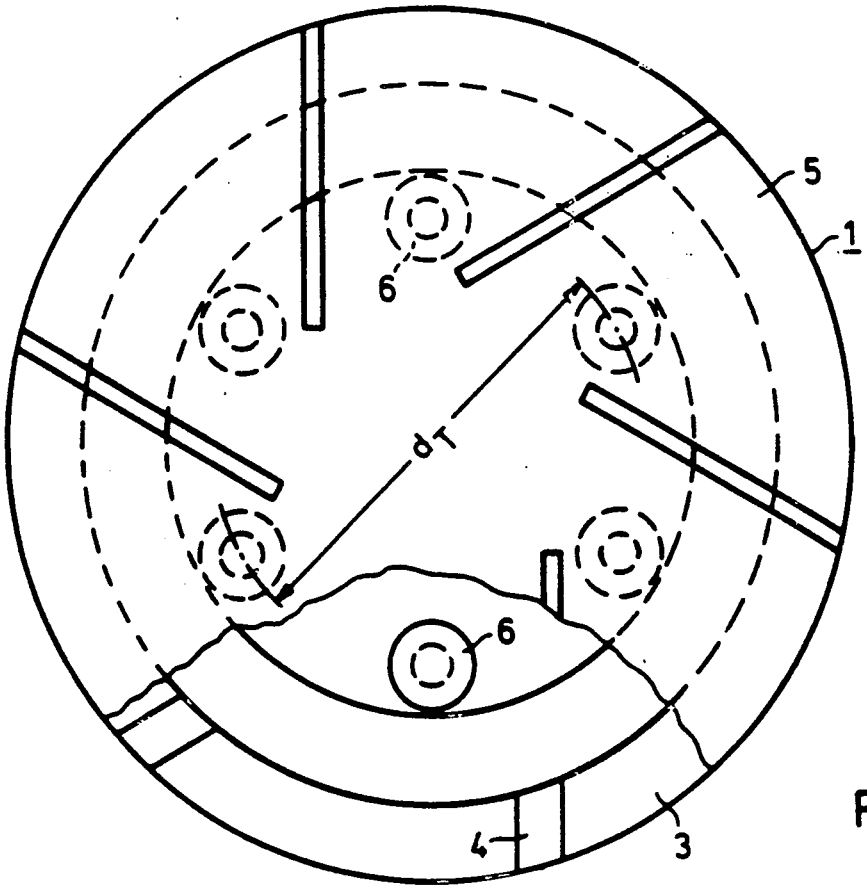
FIG. 2 shows the contact according to FIG. 1 in a top view.

With reference now to the drawings, FIGS 1 and 2 show an axial field contact 1, which consists of the current-supplying stud 2, the cup-shaped contact carrier 3 with the tilted slots 4 and the equally slotted contact plate 5. The diameter d of the current-supplying stud 2 equals approximately 60% of the external diameter D of the contact carrier 3. Post-like supporting elements 6 are mounted between the contact carrier and contact plate. These post-like supporting elements are located on a graduated circle $d_T$ whose diameter is only a little less than the external diameter of the current-supplying stud 2. According to FIG. 2, six such supporting elements are provided, whereby one supporting element is respectively mounted between the slots of the contact plate 5. If applicable, a further supporting element can be additionally mounted in the center of the contact 1. In this case, only a tubular central cross-sectional region remains free.

Figure 3:
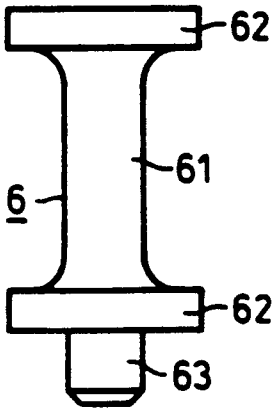
FIG. 3 shows a post-like contact element.

According to FIG. 3, each supporting element has a supporting shaft 61 and is provided with capital-type supporting surfaces 62 at the ends, i.e., in the base and top regions. The surface of these supporting surfaces approximately amounts to six times the cross section of the supporting shaft. Furthermore, a spigot 63 is provided at the bottom end of the supporting element 6, which, according to FIG. 1, engages with a corresponding bore hole of the contact carrier 3. The number of supporting elements 6 effectively ranges between three and twelve. The supporting elements 6 are soldered on the front side in a manner not shown more closely to the contact plate 5 and on the housing side in the region of the spigot 63 to the contact carrier 3.

Figure 4:
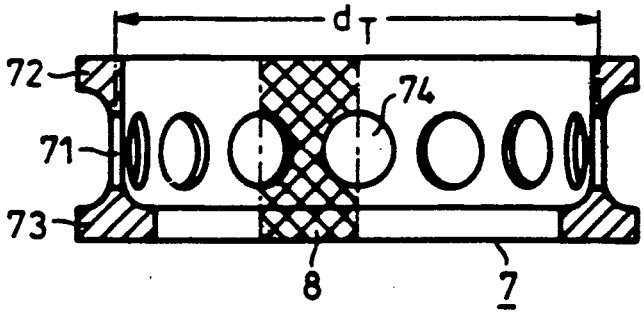
FIG. 4 shows a tubular support in longitudinal section.
Figure 5:
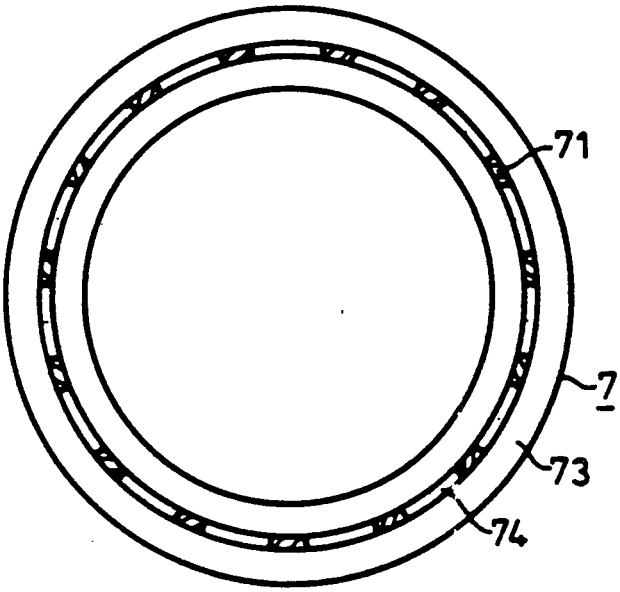
FIG. 5 shows the support according to FIG. 4 in cross section.

A tubular support structure according to FIGS. 4 and 5 can also be used in place of the post-like supporting elements according to FIG. 1. This tubular support structure consists of the actual supporting tube 71 with a top prop ring and a bottom prop ring 73. The actual supporting tube 71, whose wall thickness is selected to be as little as possible while allowing for the requisite mechanical load capacity, is thereby provided with round perforations 74. According to FIG. 4, fifteen such perforations are provided which are uniformly distributed on the circumference. The diameter of these perforations equals somewhat less than half of the total height or total length of the tubular support structure 7. The supporting surface of both prop rings 72 and 73 is approximately 5 times as large as the cross-sectional area of the actual supporting tube 71. The average wall diameter of the actual supporting tube 71 corresponds to the graduated circle diameter $d_T$.

With the aid of the perforations 74, individual supporting elements are formed which are arranged seamlessly adjacent each other on the graduated circle $d_T$. This type of individual supporting element 8 is represented in FIG. 5 as a hatched area.

A support structure designed according to FIG. 4 which consists of chromium nickel steel has at a diameter of approximately 52 mm an ohmic resistance of R=105 uohm. Post-like supporting elements according to FIG. 3 can be produced with a resistance of e.g. R=600 uohm, so that six parallel connected supporting elements have a total resistance of 100 uohm. In the case of an external diameter of the contact carrier of approximately 100 mm, a contact configuration according to FIG. 1 has an ohmic resistance of approximately 4 uohm.

Figure 6:
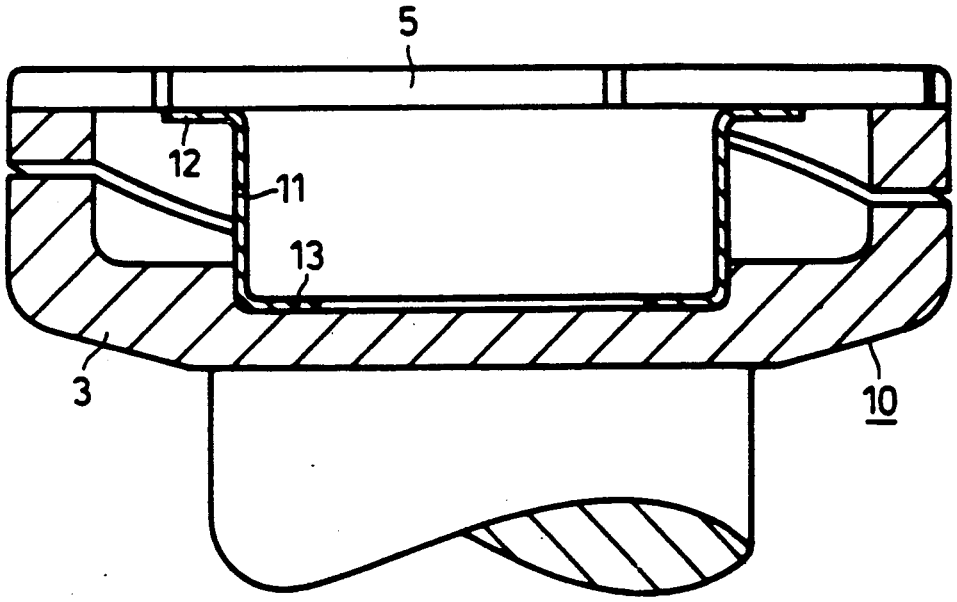
FIG. 6 shows an axial field contact with another tubular support.

FIG. 6 shows an axial field contact 10, whereby a thin-walled tube 11 having tubular supporting surfaces 12 and 13 mounted at both ends is provided as a support between the contact plate 5 and the contact carrier 3. The top supporting surface extends outward like a flange; the bottom supporting surface extends inward like a flange. If applicable, the wall of the tube can be provided with perforations in a manner similar to the support structure according to FIG. 4. In the case of this support, the bottom supporting surface can also form a traversing base, whereby such a support is able to be produced as a drawn part.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A contact configuration for a vacuum interrupter, comprising two axially opposed axial field contacts movable relative to each other in an axial direction, each axial field contact comprising a cup-shaped contact carrier and a contact plate disposed on a rim of a wall of the contact carrier, each contact carrier is provided with a cylindrical current-supplying stud, the wall of each contact carrier being provided with slots which form windings that are tilted towards the contact axis, a support comprising a material which has relatively poor electrical conductivity as compared with said contact plate being mounted between the contact carrier and contact plate of each axial field contact, the support being located on a graduated circle within a cross-sectional area of the current-supplying stud while leaving free a central cross-sectional region of the stud, a diameter of the current-supplying stud equalling at least 50% of an external diameter of the contact carrier, and a diameter of the graduated circle for the support also equalling at least 50% of the external diameter of the contact carrier and being at most equal to the external diameter of the current-supplying stud, wherein a length of the support has a considerably smaller cross section in a middle portion than in a base portion and top portion of the support, wherein an ohmic resistance of the support is at least one magnitude ten times greater than an ohmic resistance of the contact carrier and the contact plate.

2. The contact configuration recited in claim 1, wherein the support comprises a thin-walled tube having tubular supporting surfaces located at both ends.

3. The contact configuration recited in claim 1, wherein the support comprises several supporting elements mounted on the graduated circle and forming parallel electric current paths.

4. The contact configuration recited in claim 3, wherein the supporting elements have a post-like or tubular design and are present at least in a quantity of three pieces.

5. The contact configuration recited in claim 3, wherein the supporting elements form a tubular support structure whose wall is provided with several radial perforations.

6. The contact configuration recited in claim 5, wherein the perforations have a round design.

7. The contact configuration recited in claim 6, wherein the diameter of the perforations equals approximately 50% of the length of the tubular support structure.

8. The contact configuration recited in claim 1, wherein the support is soldered both to the contact carrier and to the contact plate.

9. The contact configuration recited in claim 8, wherein the ohmic resistance of the support equals approximately 100 uohm.

* * * * *